US011399631B2

(12) United States Patent
Hafsteinsson et al.

(10) Patent No.: US 11,399,631 B2
(45) Date of Patent: Aug. 2, 2022

(54) FOLDABLE SUPPORT AND RELATED METHODS

(71) Applicant: 17B EHF, Hafnafjordur (IS)

(72) Inventors: Hallgrimur Skuli Hafsteinsson, Hafnarfjordur (IS); Hafsteinn Jonasson, Reykjavik (IS)

(73) Assignee: 17B EHF, Hafnafjordur (IS)

( * ) Notice: Subject to any disclaimer, the term of this patent is extended or adjusted under 35 U.S.C. 154(b) by 142 days.

(21) Appl. No.: 16/768,005

(22) PCT Filed: Nov. 30, 2018

(86) PCT No.: PCT/IB2018/059533
§ 371 (c)(1),
(2) Date: May 28, 2020

(87) PCT Pub. No.: WO2019/116148
PCT Pub. Date: Jun. 20, 2019

(65) Prior Publication Data
US 2020/0359799 A1 Nov. 19, 2020

Related U.S. Application Data

(60) Provisional application No. 62/597,046, filed on Dec. 11, 2017.

(51) Int. Cl.

| | |
|---|---|
| ***A47C 20/00*** | (2006.01) |
| ***A47C 9/10*** | (2006.01) |
| ***A47C 7/38*** | (2006.01) |
| ***A47G 9/10*** | (2006.01) |

(52) U.S. Cl.
CPC ..... *A47C 7/383* (2013.01); *A47G 9/1081* (2013.01)

(58) Field of Classification Search
CPC ..... A47C 7/383; A47C 7/38; A47C 7/36
See application file for complete search history.

(56) References Cited

U.S. PATENT DOCUMENTS

| | | | | |
|---|---|---|---|---|
| 15,581 A | | 8/1856 | Slaughter | |
| 1,468,072 A | | 9/1923 | Hubert | |
| 1,587,749 A | * | 6/1926 | Bierly | A63C 17/06 482/80 |
| 1,787,832 A | | 1/1931 | Mueller | |
| D98,859 S | | 3/1936 | Garwood | |
| D169,631 S | | 5/1953 | Norman | |
| 2,774,601 A | | 12/1956 | White | |

(Continued)

FOREIGN PATENT DOCUMENTS

| | | |
|---|---|---|
| AU | 2003201842 A1 | 10/2003 |
| AU | 1991076466 A1 | 9/2015 |

(Continued)

OTHER PUBLICATIONS

PCT International Patent Application No. PCT/IB2018/059533, International Search Report dated Feb. 21, 2019, 4 pp.

(Continued)

*Primary Examiner* — Shin H Kim
(74) *Attorney, Agent, or Firm* — Phillips Winchester

(57) ABSTRACT

A foldable support may include a top support and a bottom support. At least one hinged connection may connect the top support to the bottom support. The hinged connection may move the top support relative to the bottom support.

20 Claims, 14 Drawing Sheets

(56) References Cited

U.S. PATENT DOCUMENTS 3,164,151 A 1/1965 Vere
3,327,330 A 6/1967 Mccullough
4,031,578 A 6/1977 Sweeney et al.
4,210,317 A 7/1980 Spann et al.
D256,728 S 9/1980 Mien
4,285,081 A 8/1981 Price
D263,625 S 3/1982 McKnight et al.
4,345,347 A 8/1982 Kantor
4,887,326 A 12/1989 OBrien et al.
5,203,611 A * 4/1993 Greenwood ..... A47D 13/107 297/275
5,209,521 A 5/1993 Osborne
5,313,678 A 5/1994 Redewill
5,352,173 A * 10/1994 McLaughlin .... A63B 23/03575 482/121
D368,527 S 4/1996 Brooke
5,625,959 A 5/1997 Ercole et al.
5,701,356 A 12/1997 Stanford et al.
5,785,388 A * 7/1998 Curtis ..... A47C 7/383 297/482
D396,594 S 8/1998 Lefebvre
D396,980 S 8/1998 Novros
D404,238 S 1/1999 Keilhauer
D414,974 S 10/1999 Marrone, II et al.
D416,745 S 11/1999 Noyes
5,974,607 A 11/1999 Smith
D419,024 S 1/2000 Lenahan et al.
6,010,192 A 1/2000 King
D420,845 S 2/2000 Rumage
6,106,123 A * 8/2000 McDonald ..... G02B 23/08 359/872
6,219,865 B1 4/2001 Stokesbary
6,230,348 B1 5/2001 Patrikakis
6,230,349 B1 5/2001 Silver et al.
D443,461 S 6/2001 Hall et al.
D444,981 S 7/2001 Hall et al.
D445,624 S 7/2001 Futagami
D446,863 S 8/2001 Carroll
6,408,468 B1 6/2002 Comfort
6,435,617 B1 8/2002 McNair
6,447,468 B1 9/2002 Hankins et al.
D481,247 S 10/2003 Roberts et al.
6,658,681 B2 12/2003 Britto et al.
D486,028 S 2/2004 Cathey
6,684,431 B2 * 2/2004 Splane, Jr. ..... A47C 20/026 5/657
D501,349 S 2/2005 Harris et al.
6,857,149 B2 * 2/2005 Hoggatt ..... A47C 20/026 5/632
D503,062 S 3/2005 Nash
6,926,686 B2 8/2005 Cheatham
D522,300 S 6/2006 Roberts
7,070,076 B2 7/2006 Bergkvist
7,175,567 B2 * 2/2007 Barbafieri ..... A63B 5/08 482/30
7,185,378 B2 3/2007 Smith
7,225,485 B2 6/2007 Binder
D550,495 S 9/2007 Boutin
D567,562 S 4/2008 Nash
7,437,788 B1 10/2008 Holman
D582,045 S 12/2008 James
D582,713 S 12/2008 Baldwin
D597,364 S 8/2009 Lindgren
D607,682 S 1/2010 Presman et al.
D619,402 S 7/2010 Sternlight et al.
7,779,492 B2 8/2010 Mangano
7,788,752 B2 9/2010 Tidwell et al.
7,789,815 B2 9/2010 An
7,865,987 B2 1/2011 Deetsch
7,909,406 B2 3/2011 Samuelsen
D637,439 S 5/2011 Mettler
D637,440 S 5/2011 Mettler
D647,624 S 10/2011 Thorgilsdottir et al.
8,144,913 B1 3/2012 Myles, Jr.
8,239,987 B2 8/2012 Sharp
8,316,488 B2 11/2012 Rojas
8,321,977 B1 12/2012 Kummerfeld et al.
8,496,582 B2 7/2013 Winston
8,528,970 B2 * 9/2013 Edalati ..... A47C 7/383 297/163
8,584,283 B2 * 11/2013 Mabry ..... A47C 16/00 5/632
8,584,285 B1 11/2013 Sipherd
8,814,106 B2 * 8/2014 Aguilera ..... A47C 7/383 248/118
8,985,693 B2 * 3/2015 Purpura ..... B60R 7/043 297/394
9,132,756 B1 9/2015 Witte et al.
9,526,360 B2 12/2016 Sternlight et al.
9,770,113 B1 * 9/2017 Miller ..... A47C 16/00
9,867,486 B2 * 1/2018 Scrimshaw ..... A47G 9/1081
10,179,261 B2 * 1/2019 Licklider ..... A63B 21/023
10,383,451 B2 * 8/2019 Miller ..... A47C 16/00
10,426,270 B2 * 10/2019 Beaulieu ..... A47C 7/66
10,433,643 B2 * 10/2019 Djankovich ..... A47C 20/027
10,646,045 B2 * 5/2020 Hill ..... F16M 11/2021
10,758,051 B2 * 9/2020 Walker ..... B60N 2/60
10,980,349 B2 * 4/2021 Miller ..... A47C 7/383
11,089,875 B2 * 8/2021 Djankovich ..... A47C 7/425
2001/0054837 A1 12/2001 OConnor
2003/0137178 A1 7/2003 Craft et al.
2005/0150050 A1 7/2005 Wolf et al.
2005/0179300 A1 8/2005 OConnor et al.
2005/0229498 A1 10/2005 Eichin
2006/0138188 A1 * 6/2006 Kramer ..... A45F 3/08 224/581
2007/0033737 A1 2/2007 Melton
2007/0056107 A1 3/2007 Gabriel
2007/0067915 A1 3/2007 Pryor
2007/0238590 A1 10/2007 Jin
2007/0271703 A1 11/2007 Matthews Brown et al.
2008/0104764 A1 5/2008 Chen
2008/0216244 A1 9/2008 Minton
2008/0301908 A1 12/2008 Chiang et al.
2009/0013471 A1 1/2009 Yang
2009/0133193 A1 5/2009 Weise
2010/0133888 A1 6/2010 Montuore
2011/0113557 A1 5/2011 Aguilera
2011/0169316 A1 * 7/2011 Goei ..... A47C 16/00 297/391
2011/0235832 A1 9/2011 Riopel
2011/0314609 A1 12/2011 Lee
2012/0011655 A1 1/2012 Rojas
2012/0012431 A1 * 1/2012 Hamilton ..... A45F 4/00 190/18 A
2012/0047656 A1 * 3/2012 Benton ..... A47C 7/383 5/640
2012/0143109 A1 6/2012 Krenzel
2012/0144590 A1 6/2012 Sharp
2013/0125312 A1 5/2013 Harooni
2013/0232693 A1 9/2013 Myers
2013/0232696 A1 9/2013 Halimi et al.
2013/0345028 A1 * 12/2013 Bes ..... A63B 22/0056 482/79
2015/0001905 A1 * 1/2015 Jackow ..... B60N 2/806 297/397
2015/0082546 A1 3/2015 Sternlight et al.
2015/0257555 A1 9/2015 Wong
2015/0297003 A1 * 10/2015 Ahroon ..... G06T 7/33 206/38
2017/0020313 A1 * 1/2017 Sanh ..... A47G 9/1045
2017/0049655 A1 * 2/2017 Sung ..... A63B 23/025
2017/0188715 A1 * 7/2017 Hill ..... B60N 2/882
2017/0202378 A1 7/2017 Scrimshaw et al.
2017/0340125 A1 * 11/2017 Miller ..... A47C 16/00
2018/0332968 A1 * 11/2018 Djankovich ..... A47C 7/425
2019/0365110 A1 * 12/2019 Miller ..... A47C 7/383

(56) References Cited

U.S. PATENT DOCUMENTS

| | | | | |
|---|---|---|---|---|
| 2020/0359799 | A1* | 11/2020 | Hafsteinsson | A47C 16/025 |
| 2021/0212472 | A1* | 7/2021 | Miller | A47C 7/383 |

FOREIGN PATENT DOCUMENTS

| | | | |
|---|---|---|---|
| GB | 2290705 | A | 1/1996 |
| KR | 1020050019575 | A | 1/1996 |
| KR | 1020050019757 | A | 1/1996 |
| KR | 200424871 | Y1 | 8/2006 |
| RU | 34338 | U1 | 12/2003 |
| WO | 2011122769 | A2 | 10/2011 |
| WO | WO2019116148 | | 6/2019 |

OTHER PUBLICATIONS

PCT International Patent Application No. PCT/IB2018/059533, Written Opinion dated Feb. 21, 2019, 7 pp.

* cited by examiner

FOLDABLE SUPPORT AND RELATED METHODS

CROSS-REFERENCE TO RELATED APPLICATIONS

This application is a national phase entry under 35 U.S.C. § 371 of International Patent Application PCT/IB2018/059533, filed Nov. 30, 2018, designating the United States of America and published in English as International Patent Publication WO 2019/116148 on Jun. 20, 2019 for "Foldable Support and Related Methods," which claims the benefit of the filing date of U.S. Provisional Patent Application Ser. No. 62/597,046, filed Dec. 11, 2017, for "Foldable Support and Related Methods," the disclosure of both of which are hereby incorporated herein in their entireties by this reference.

TECHNICAL FIELD

Embodiments of the disclosure relate generally to bracing and/or support devices or apparatus, specifically foldable bracing and/or support devices or apparatus and to methods of using the foldable bracing and/or support devices.

BACKGROUND

Support devices are often used for supporting a portion of a subject's or user's anatomy while the user is resting. For example, pillows are often used to support a user's head and neck while resting. Some examples of pillows include standard pillows that generally provide support for the head and neck in a laying position. Other examples of pillows include travel pillows. A travel pillow is generally configured to provide support for the head and neck when a user is in a vertical (e.g., upright, sitting) position.

Some examples of travel pillows are described in U.S. Pat. Nos. 6,230,349, and 8,239,987. Both of these patents include examples of pillows designed to provide support to a user's head and neck when resting in a vertical position. Some of the common features of these pillows are that they have a general "U"-shape for cradling a user's head and neck. Pillows with these configurations are often used by travelers when sitting in airplanes, buses, cars, etc.

Support devices are often large and bulky. Large and bulky support devices can be problematic when traveling or storing the devices. For travelers a large and bulky support device can take up valuable space in luggage, or be cumbersome when boarding a bus or airplane. When not in use large and bulky support devices can take up valuable storage space in homes and offices.

SUMMARY

In some embodiments, a support may include a first portion and a second portion. The first portion may be configured to support a portion of the user's head. The second portion may be configured to engage with at least one of the user's chest, back, and/or shoulders. The first portion and the second portion may be connected with at least one coupling member. The coupling member may be configured to selectively enable movement of the first portion relative to the second portion. The coupling member may also be configured to apply a force (e.g., a moment) between the first portion and the second portion when the support is in an expanded position to counteract a weight of the user's head engaging with the first portion.

The above embodiment may further include wherein the support is configured to compress into a collapsed position. One or more of the above embodiments may further include wherein the first portion and the second portion are each configured to lie in parallel planes when the support is in the collapsed position. One or more of the above embodiments may further include the first portion is configured to define an at least partially twisted surface of the first portion when the support is in the expanded position. One or more of the above embodiments may further include wherein the at least one coupling member is configured to introduce a twist into the first portion to define the at least partially twisted surface of the first portion when the support is in the expanded position. One or more of the above embodiments may further include a releasable locking connection configured to apply the force in order to secure the first portion relative to the second portion. One or more of the above embodiments may further include wherein the releasable locking connection further comprises a ratcheting connection. One or more of the above embodiments may further include wherein the at least one coupling member is configured to enable movement of the first portion away from the second portion and configured to substantially prevent movement of the first portion back toward the second portion. One or more of the above embodiments may further include a padded cover surrounding at least a portion of the first portion One or more of the above embodiments may further include the coupling member comprising at least one hinged connection connecting the first portion comprising a top support with an adjustable shape to the second portion comprising a bottom support and configured to change the adjustable shape of the top support and a locking mechanism configured to lock the top support relative to the bottom support.

One or more of the above embodiments may further include wherein the at least one hinged connection is configured to enable the top support to move relative to the bottom support until the top support is adjacent to the bottom support. One or more of the above embodiments may further include wherein the top support substantially lies in a plane that is substantially parallel to a plane that the bottom support substantially lies in when the top support is adjacent to the bottom support in a collapsed position. One or more of the above embodiments may further include wherein the foldable support exhibits a substantially flat orientation when the top support is adjacent to the bottom support. One or more of the above embodiments may further include wherein the locking mechanism comprises a releasable locking mechanism, wherein the releasable locking mechanism comprises at least one release configured to disengage the locking mechanism.

One or more of the above embodiments may further include wherein the at least one release is attached to a latching member of the releasable locking mechanism. One or more of the above embodiments may further include wherein the releasable locking mechanism comprises at least two releases, wherein a first release is attached to the latching member of the releasable locking mechanism and a second release is attached to a stop of the releasable locking mechanism. One or more of the above embodiments may further include wherein the locking mechanism comprises a plurality of stops, wherein the plurality of stops is configured to place the foldable support in a plurality of positions. One or more of the above embodiments may further include wherein the top support and the bottom support comprise an elastomeric polymer.

In some embodiments, a foldable support may comprise a top support and a bottom support. The top support may have an adjustable shape. The foldable support may include a hinged connection connecting the top support to the bottom support. The hinged connection may be configured to change the adjustable shape of the top support. A locking mechanism may be configured to lock the top support relative to the bottom support.

Methods of adjusting a support may include supporting a user's head with a head supporting member that has a shape that is at least partially complementary to a lower portion of the user's head. The method may further include articulating the head supporting member relative to a lower support about at least one hinge assembly and securing the head supporting member in a desired position relative to the lower support with the at least one hinge assembly.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
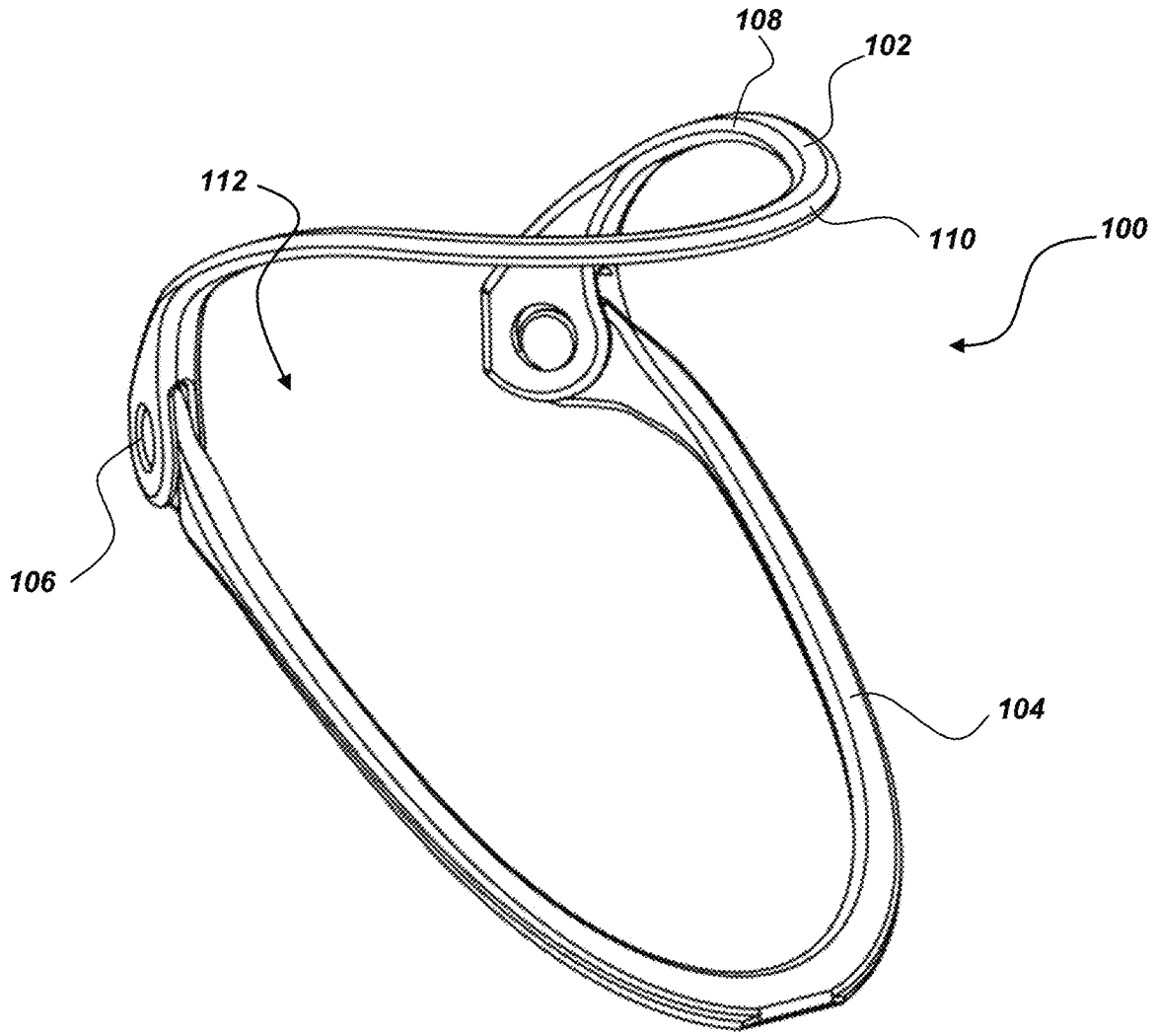
FIG. 1 is a perspective view of a support in expanded position according to an embodiment of the present disclosure.

The illustrations presented herein are not meant to be actual views of any particular support or component thereof, but are merely idealized representations employed to describe illustrative embodiments. The drawings are not necessarily to scale. Elements common between figures may retain the same numerical designation.

As used herein, any relational term, such as "first," "second," "top," "bottom," etc., is used for clarity and convenience in understanding the disclosure and accompanying drawings and does not connote or depend on any specific preference, orientation, or order, except where the context clearly indicates otherwise. In some embodiments, these and other relational terms may be used in a frame of reference relative to the anatomy of a user sitting or standing in an upright position.

As used herein, the term "and/or" means and includes any and all combinations of one or more of the associated listed items.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "elastomeric polymer" means and includes a polymer capable of recovering its original size and shape after deformation. In other words, an elastomeric polymer is a polymer having elastic or viscoelastic properties. Elastomeric polymers may also be referred to as "elastomers" in the art. Elastomeric polymers include, without limitation, homopolymers (polymers having a single chemical unit repeated) and copolymers (polymers having two or more chemical units).

Embodiments of the present disclosure may relate to supports for a portion of a user's body (e.g., ergonomic supports, braces, head and/or neck supports, headrests, etc.) that may be folded or collapsed in a way that reduces the amount of space required for storage of the supports. The collapsible supports may maintain complementary shapes to the appendage or object they are intended to support.

For example, embodiments of the present disclosure may relate to an ergonomic support that may be folded to a collapsed position (e.g., a substantially flat position). The ergonomic support maintains an expanded shape (e.g., an ergonomic shape that is at least partially complementary to a majority of the anatomical features of an intended user, such as, for example, an anatomical shape, a form fitting shape, a cylindrical shape, etc.) when the ergonomic support is expanded and in use. The ergonomic support may be used to support one or more portions of a user's body, such as, for example, a user's head and/or neck, leg and/or knee, arm and/or elbow, or any other area where a user may need a support or brace. The ergonomic support may be formed in different sizes and shapes depending on the area being supported and/or the age or size of the user. For example, components of the support may be designed, configured, and/or sized to fit or to be adjusted to fit a majority of an intended population of users (e.g., a median, a mean, etc., of the intended population).

Supports may be used to support an area while the user is resting to increase comfort, prevent muscle or joint fatigue, support an injured area, or prevent a weak area from becoming injured. For example, a head and/or neck support may support a user's head when sleeping in an upright position to prevent neck pain and/or fatigue, support an injured (e.g., strained and/or broken neck), or support the neck of an incapacitated user to prevent the neck from becoming injured. In another example, a knee support may support an injured knee, or support a knee following surgery to prevent an injury due to the knee being in a weak state following surgery.

FIG. 1 illustrates an embodiment of a support 100 (e.g., a head and/or neck support) in an expanded position. The support 100 includes a top support 102 (e.g., upper support, head support, head supporting member, head supporting portion) and a bottom support 104 (e.g., lower support, chest portion of the support, chest engaging member, chest engaging portion). The top support 102 may be connected to the bottom support 104 with a coupling member, such as, for example, a connection feature (e.g., hinge 106, pivot, hinged connection, joint, adjustable connection point or feature). In some embodiments, the top support 102, bottom support 104, and coupling member may be unitary (e.g., integrated, undivided, single piece of material, single structure).

In some embodiments, the top support 102 may have an ergonomic shape that is at least partially defined in a manner that is complementary to the portion of the user that is to be supported. For example, the top support 102 may extend from the hinge 106 in a shape that is complementary to and engages with one or more portions of a user's head (e.g., a bottom portion of the user's chin and/or jaw and/or sides portions of the user's head and/or jaw. The top support 102 may be a frame member (e.g., having a polygonal cross section, a curved and/or elliptical cross section, a rectangular cross section) having a semi-annular shape (e.g., a portion of a ring, a portion of a circle, a portion of a ellipse, a portion of a oval, a horseshoe shape, etc.). The top support 102 may include side portions 108 rising above a front portion 110 forming a curve when viewed from the side (e.g., along or in the coronal plane). The support 100 may have an opening 112 in the back of the support 100 to enable the support 100 to be placed around a user's neck. In some embodiments, when the support 100 is placed around the user's neck the side portions 108 of the top support 102 may support the user's head laterally by running along the cheek and/or lower jaw of the user's head while the front portion 110 may be lower than the side portions 108 enabling the bottom of the user's chin and/or jaw to rest on the front portion 110. The shape of the support 100 may provide lateral and vertical support to the user's head. The shape of the support 100 may increase the comfort of the support for the user as well.

In some embodiments, the bottom support 104 may also have an ergonomic shape. The bottom support 104 may be a semi-annular frame member (e.g., having a polygonal cross section, a curved, and/or elliptical cross section, a rectangular cross section). When viewed from the side, the bottom support 104 may be curved in a way that is substantially similar and/or complementary to a user's chest. In some embodiments, the curve in the bottom support 104 may be substantially similar to the curve in the top support 102. In some embodiments, the bottom support 104 may extend a greater distance from the opening 112 in the back of the support 100 than the top support 102.

In some embodiments, the hinge 106 may allow the top support 102 to articulate (e.g., rotate, or pivot) relative to the bottom support 104. The support 100 may be placed in a collapsed position by rotating the top support 102 relative to the bottom support 104 until the top support 102 contacts the bottom support 104. In the collapsed position, the top support 102 may be substantially parallel to the bottom support 104. For example, the top support 102 may lie in substantially the same plane as the bottom support 104 or may lie in a plane that is adjacent and substantially parallel to a plane in which the bottom support 104 is positioned.

In some embodiments, the hinge 106 may enable the top support 102 and the bottom support 104 to move relative to one another, such that an angle between the top support 102 and the bottom support 104 may be adjustable. In some embodiments, the hinge 106 may include a locking mechanism, discussed below in greater detail. The locking mechanism may have at least one locking position. When in the locking position the locking mechanism may substantially inhibit motion of the top support 102 relative to the bottom support 104. In some embodiments, the locking mechanism may include a plurality of locking positions.

Figure 2:
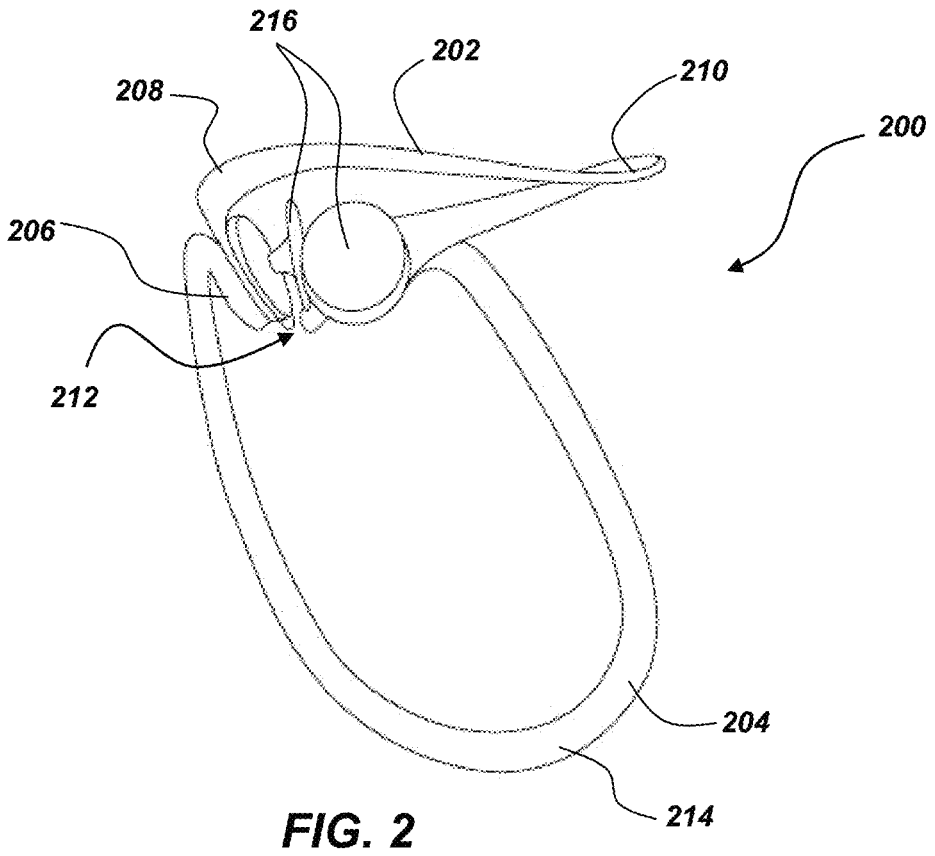
FIG. 2 is a perspective view of a support in an expanded position according to an embodiment of the present disclosure.
Figure 3:
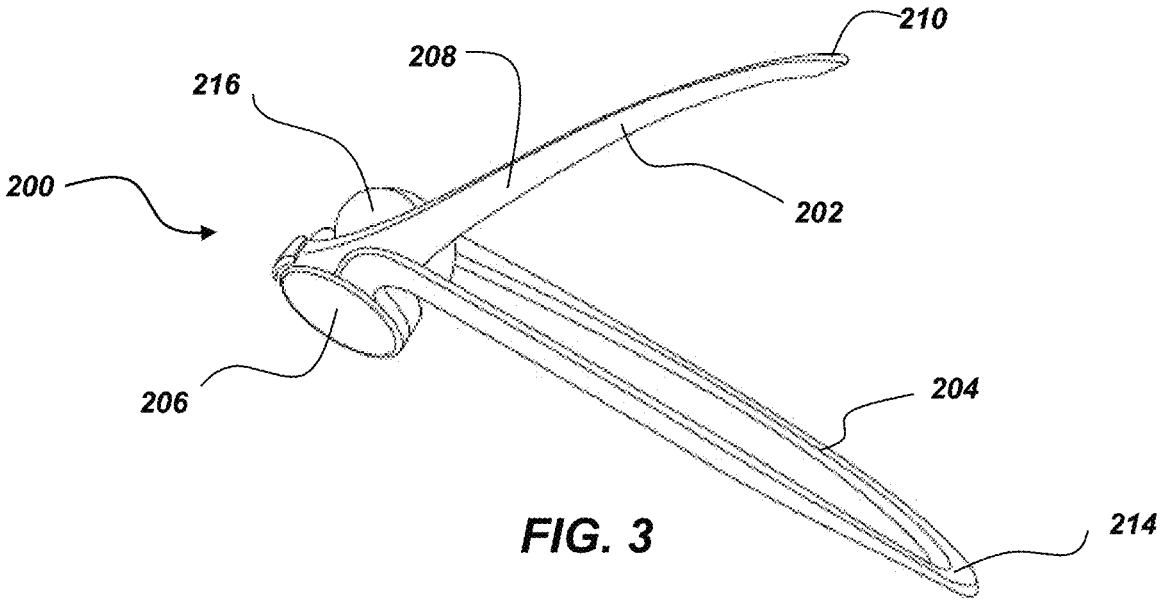
FIG. 3 is a side view of a support in an expanded position according to an embodiment of the present disclosure.
Figure 5:
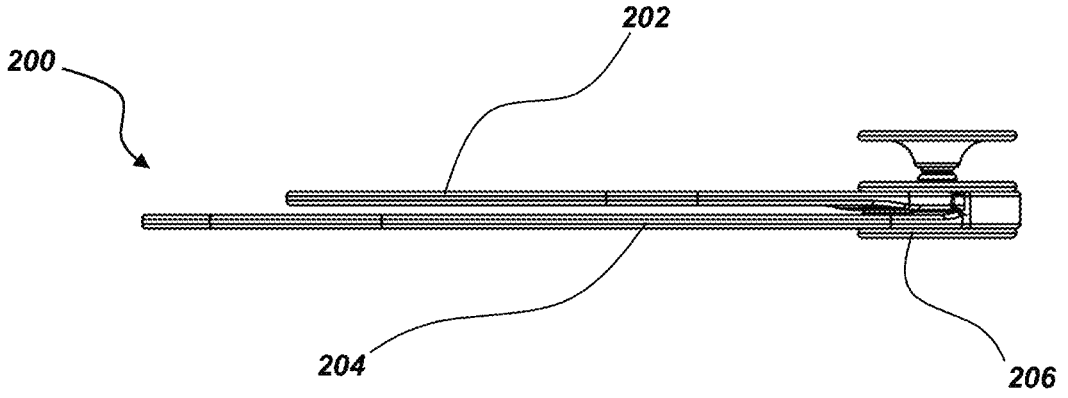
FIG. 5 is a side view of a support in a compressed position according to an embodiment of the present disclosure.

FIG. 2 is a perspective view of a support 200 in an expanded position and FIG. 3 is a side view of a support (e.g., the support 200 of FIG. 2) in an expanded position. Referring to FIGS. 2 and 3, the support 200 may include a top support 202 and a bottom support 204 connected by hinges 206. The top support 202 may be formed from a flexible material that may be moved between a substantially planar position (e.g., as shown in FIG. 5) and a twisted (e.g., turning, or tortuous expanded position (e.g., as shown in FIG. 2). As depicted, in some embodiments, the top support 202 may have a substantially rectangular cross section with two major planar sides having planar surfaces (e.g., for at least partially engaging portions of the user) and two minor sides extending between the major sides. In some embodiments, such a twist may comprise an angular variation of a selected amount of degrees of the major planar sides of the top support 202 (e.g., 5 degrees, 15 degrees, 30 degrees, 45 degrees, 60 degrees, 90 degrees, or more).

In some embodiments, the top support 202 and/or the bottom support 204 may have a non-rectangular cross section (e.g., an elliptical cross section, a triangular cross section, a C-channel cross section, etc.) The twist may comprise an angular variation of a selected amount of degrees of at least one plane of the top support and/or bottom support.

The hinges 206 may be substantially vertical (e.g., positioned in a direction transverse to the direction which the top support 202 and/or bottom support 204 extend, positioned in the sagittal plane) when the support 200 is in an expanded position. The top support 202 may form a semi-annular shape with an opening 212 in the back between the hinges 206. The top support 202 may have sides 208 where the planar surface may be set in a plane transverse (e.g., substantially perpendicular) to a plane in which another portion of the top support 202 extends (e.g., a front portion 210). The planar surface of the top support 202 may gradually transition from the transverse plane of the sides 208 to the plane in which a majority of the front portion 210 lies, which may be substantially parallel to a plane in which the top support 202 is positioned in a retracted position (see, e.g., FIG. 5).

In some embodiments, the bottom support 204 may also be formed from a flexible material that may be moved between a substantially planar position (e.g., as shown in FIG. 5) and a twisted, turning, or tortuous expanded position (e.g., as shown in FIG. 2). As depicted, the top support 202 may have a substantially rectangular cross section with two major planar sides having planar surfaces (e.g., for at least partially engaging portions of a user) and two minor sides extending between the major sides. In some embodiments, such a twist may comprise a variation of a selected amount of degrees of the major planar sides of the top support 202 (e.g., 5 degrees, 15 degrees, 30 degrees, 45 degrees, 60 degrees, 90 degrees, or more).

The bottom support 204 may at least partially or substantially extend in a similar manner to the top support 202 with the planar surfaces of the bottom support 204 transitioning from a plane transverse (e.g., substantially perpendicular) to the plane in which another portion of the bottom support 204 (e.g., front portion 214) extends to the plane in which a majority of the front portion 214 lies, which may be substantially parallel to a plane in which the bottom support 204 is positioned in a retracted position (see, e.g., FIG. 5).

In some embodiments, the support 200 may include support pads 216 extending from the hinges 206. The support pads 216 may locate (e.g., secure, center, maintain) the support 200 relative to a user. For example, on a head and/or neck support, the support pads 216 may contact the back of the user's neck securing the support 200 in place with the top support 202 contacting the user's head and the bottom support 204 contacting the user's chest, shoulder(s) and/or back. The support pads 216 may be pivotally mounted to the hinges 206. The pivotal support may enable the support pads 216 to conform to the user's anatomy.

In some embodiments, the support pads 216 may be removable. For example, the support pads 216 may have different sizes that may be interchangeable to adjust the support 200 to fit or be customized for different users. In some embodiments, the support pads 216 may be formed from different materials. For example, the support pads 216 may be interchangeable for different applications. For example, a support 200 being used to prevent fatigue while resting may use support pads 216 with a lower stiffness (e.g., elastic modulus, Young's Modulus) for increased comfort, while a support 200 that may be used to support an injury may require support pads 216 made from a material with a higher stiffness. In another embodiment, the support pads 216 may be interchangeable for support pads 216 of different shapes. By way of non-limiting example, the support pads 216 may be a circular shape, an oblong shape, an oval shape, a crescent shape, etc.

Figure 4:
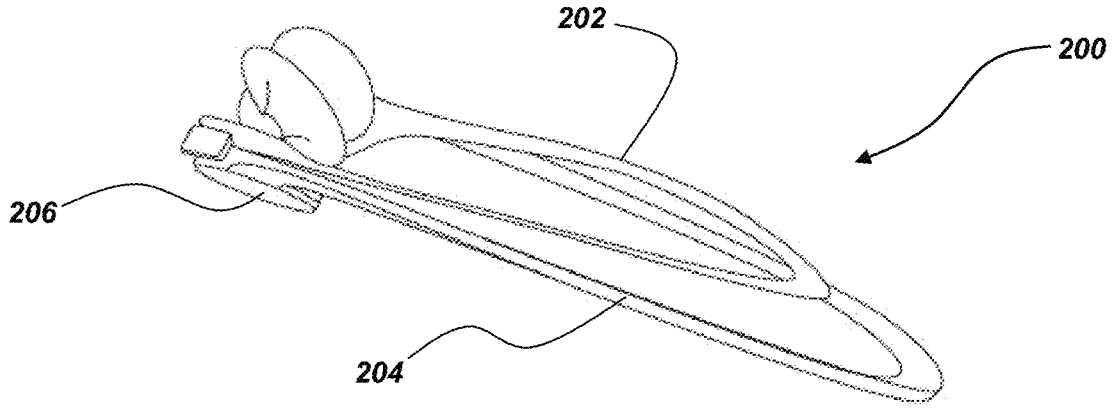
FIG. 4 is a perspective view of a support in a compressed position according to an embodiment of the present disclosure.

FIG. 4 is a perspective view of a support (e.g., the support 200 of FIGS. 2 and 3) in a compressed position and FIG. 5 is a side view of the support in a compressed position. As shown in FIGS. 4 and 5, the support 200 may be configured to collapse into a collapsed (e.g., closed, compressed, passive, storage, retracted) position. In a collapsed position, the top support 202 may be substantially parallel to the bottom support 204. In some embodiments, the hinge 206 may be configured to enable the top support 202 and the bottom support 204 to articulate relative to each other. As the top support 202 and the bottom support 204 articulate from an expanded (e.g., open, active, supporting) position to the collapsed position, the hinges 206 may transition (e.g., substantially 45 to 90 degrees) from a partially or substantially vertical or upright orientation to a substantially horizontal or flat orientation. As the hinges 206 transition to the horizontal orientation, the planar surfaces of the top support 202 and the bottom support 204 may also transition such that the entire planar surfaces of the top support 202 and the bottom support 204 form substantially horizontal or flat surfaces. In some embodiments, the substantially horizontal surfaces of the top support 202 and the bottom support 204 may be in contact with or directly adjacent each other in the collapsed position and the support 200 may be substantially flat.

Now referring to FIGS. 3 and 4, the hinges 206 may be configured to articulate between a horizontal position (e.g., a flat position in a plane substantially parallel to the flat top support 202 and bottom support 204) and a vertical or upright position in response to the support 200 moving between a collapsed position and an expanded position. As the hinges 206 transition from the horizontal position to the vertical or upright position, the hinges 206 may introduce a twisting force (e.g., moment, or torque) in the top support 202 and the bottom support 204. The twisting force may cause the top support 202 and bottom support 204 to transition from fully horizontal or flat surfaces to ergonomically shaped surfaces.

In some embodiments, the twisting force may also introduce additional strength into the support 200. The twisting force may increase the moment of inertia (e.g., an area moment of inertia) for at least a portion of the top support 202 and/or the bottom support 204. An increase in the moment of inertia for an item increases the amount of force necessary to cause deflection. Therefore, as the moment of inertia for the top support 202 or the bottom support 204 increases the strength of the support also increases.

Figure 6:
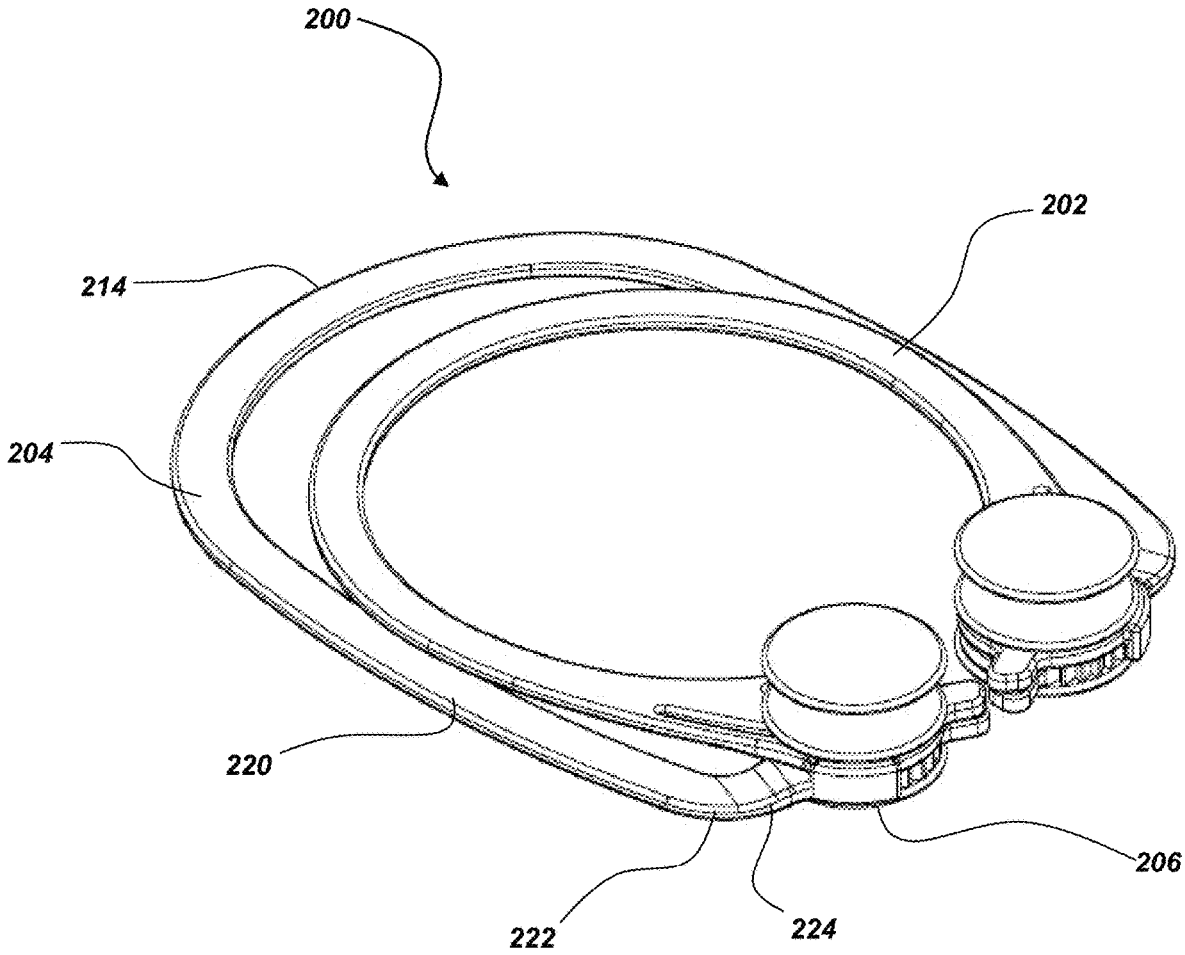
FIG. 6 is a perspective view of a support in a compressed position according to an embodiment of the present disclosure.

FIG. 6 is a perspective view of a support (e.g., the support 200 of FIGS. 2 through 5) in a compressed position. As shown in FIG. 6, the top support 202 may have a different shape than the bottom support 204. The different shapes may react differently to the twisting forces created by the hinges 206. In some embodiments, the top support 202 may have a substantially elliptical (e.g., circular) shape. In some embodiments, the bottom support 204 may have sides 220 that are substantially straight. The sides 220 may extend between an arch on the front portion 214 of the bottom support 204 and a corner 222 on a back portion 224 of the bottom support 204. The corner 222 may be a bend between about a 20° angle and about a 90° angle, such as between about a 45° angle and about a 50° angle, about a 50° angle and about a 55° angle, about a 55° angle and about a 60° angle, about a 60° angle and about a 65° angle, about a 65° angle and about a 70° angle, about a 70° angle and about a 75° angle, about a 75° angle and about an 80° angle, about an 80° angle and about an 85° angle, or about an 85° angle and about a 90° angle. For example, the angle may be between about 70° and 85°, such as between about 75° and 80°, or about 77°. The angle may be selected based on the amount of deflection desired from the twisting forces exerted by the hinges 206.

Figure 8:
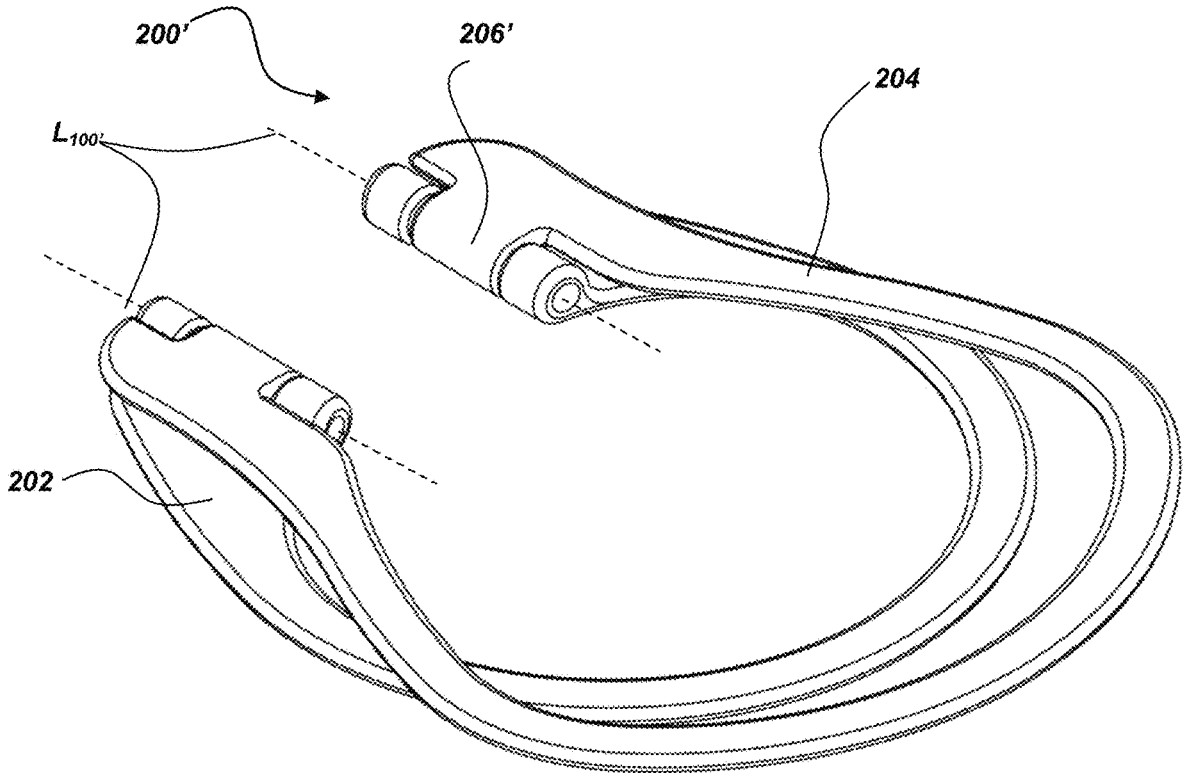
FIG. 8 is a perspective view of a support in a compressed position according to an embodiment of the present disclosure.

FIG. 8 is a perspective view a support 200' in a compressed position. In some embodiments, the support 200' may be similar to and include components of the supports 100, 200 discussed above. As shown in FIG. 8, one or more of the hinges 206' may be positioned such that the axis $L_{100'}$ of the hinges 206' is positioned in or substantially parallel to the plane of the top support 202 and the bottom support 204, when the top support 202 and the bottom support 204 are in a compressed position. For example, in the compressed state, a majority of the top support 202, the bottom support 204, the hinges 206', and axis $L_{100'}$ of the hinges 206' may lie in or be directly adjacent the same plane.

In some embodiments, when moving between the expanded and compressed positions, the axes $L_{100'}$ of the hinges 206' may remain substantially stationary with respect to one another as the top portion 202 and the bottom portion 204 articulate. When moving to the expanded state, the orientation of the hinge 206' may create a moment on the top support 202 and the bottom support 204 as the top support 202 and the bottom support 204 move relative to one another into an expanded position. The moment created by the hinge 206' may cause the top support 202 and the bottom support 204 to form a twisted, turning, or tortuous expanded position similar to that shown in FIGS. 2 and 3.

In some embodiments, the hinges of the support 200' may include a locking mechanism, such as, for example, those discussed herein, in order to fix the support 200' in a selected position (e.g., an expanded position).

In some embodiments, such as the embodiments described above, the top support 202 and bottom support 204 may be formed from at least partially flexible materials. Some materials may include composites (e.g., fiberglass, carbon fiber), elastomeric polymers (e.g., polyethylene terephthalate (PETG), PVC), rubber, metals (e.g., sheet steel, aluminum), wood, MDF, and cardboard. The material may be selected based on its flexibility and fatigue resistance. In some embodiments, the material may be selected to exhibit a selected hardness or durometer (e.g., 60 to 80 shore D, 75 shore D, etc.). Some more flexible materials may allow more articulation while less flexible materials may require more force to create the same amount of articulation. More flexible materials may provide less support for the support 200, while less flexible materials may provide more support making the support 200 stronger. Some applications may require a more flexible material while other applications may require a stronger material. For example, a headrest may require a more flexible material to provide a comfortable fit to the user's head. In another embodiment, a headrest may require a stronger material to withstand jarring forces, such as, for example, on a turbulent flight.

Figure 7:
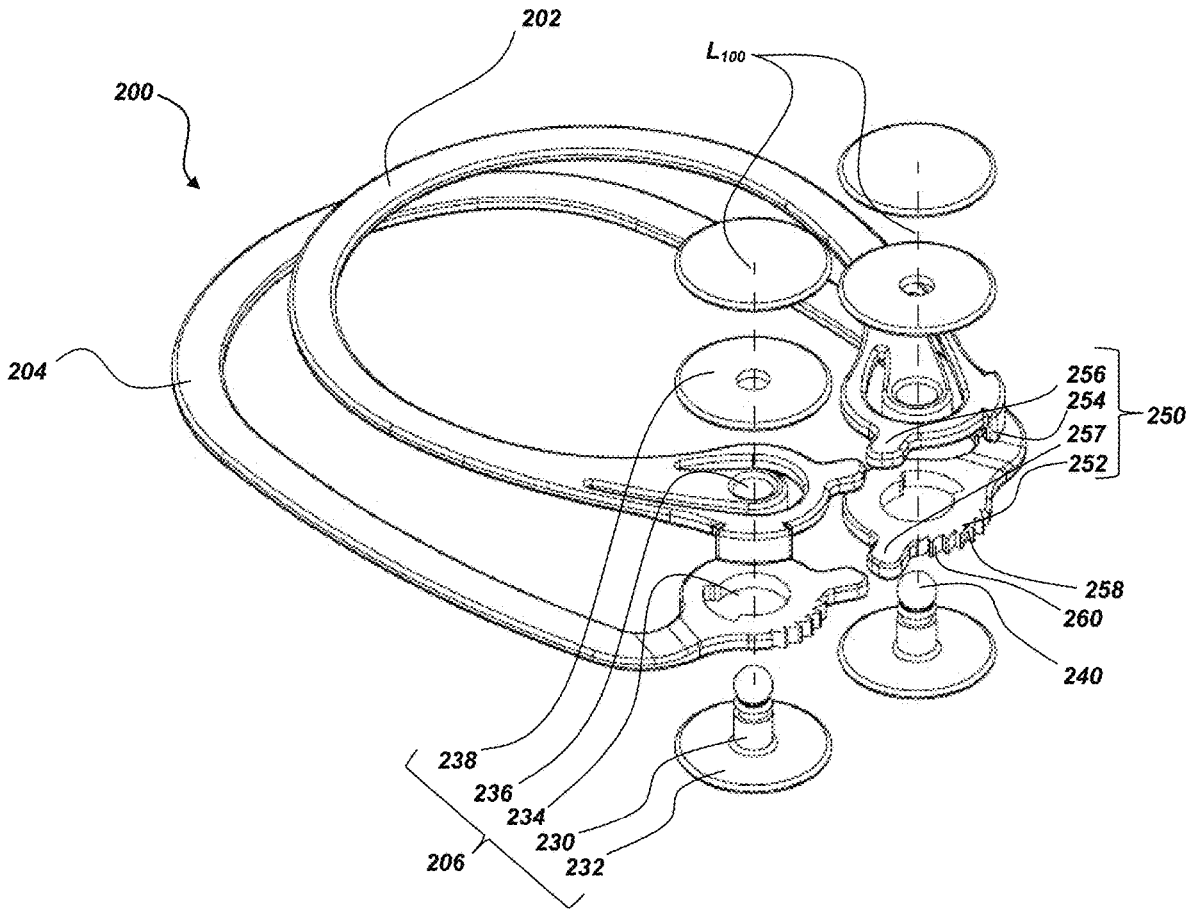
FIG. 7 is an exploded view of a support according to an embodiment of the present disclosure.

FIG. 7 is an exploded view of a support (e.g., the support 200 of FIGS. 2 through 6). As shown in FIG. 7, the hinge 206 (e.g., hinge assembly) may include a pin 230. The pin 230 may protrude from a base 232. The pin 230 may protrude through a first hole 234 in the bottom support 204 and a second hole 236 in the top support 202. The pin 230 may substantially align the first hole 234 and the second hole 236. A retainer 238 may attach to the pin 230 on an opposite side of the top support 202 and the bottom support 204 from the base 232. The retainer 238 and the base 232 may substantially limit the movement of the top support 202 and the bottom support 204 such that the top support 202 and the bottom support 204 may only move relative to each other in a plane that is perpendicular to an axis $L_{100}$ of the pin 230.

In some embodiments, the axes $L_{100}$ of the pins 230 for each hinge 206 may be substantially parallel when in the collapsed position. When the support 200 is articulated into its expanded position, the axes $L_{100}$ for each pin 230 may rotate such that the axes $L_{100}$ of each pin 230 are moved from this parallel position (e.g., are no longer parallel in this plane). The rotation of each axis $L_{100}$ may enable the top support 202 to rotate relative to the bottom support 204 due to the retainer 238 and the base 232 limiting the movement of the top support 202 and the bottom support 204 to a plane perpendicular to the axis $L_{100}$. As the axis $L_{100}$ rotates, the hinge 206 on each side of the top support 202 and the bottom support 204 may introduce a twisting force into the top support 202 and the bottom support 204 due to the rotation of the hinge 206 between the planar position shown in FIG. 7 to a transverse position as shown in FIGS. 2 and 3.

In some embodiments, the pads 216 may be connected to a connection point 240 on the end of the pin 230 opposite the base 232. In some embodiments, the connection point 240 may be a ball joint (e.g., ball and socket, heim joint, rod-end bearing). The pads 216 may be allowed to pivotally move relative to the pins 230 to conform to the anatomy of the user.

Figure 9:
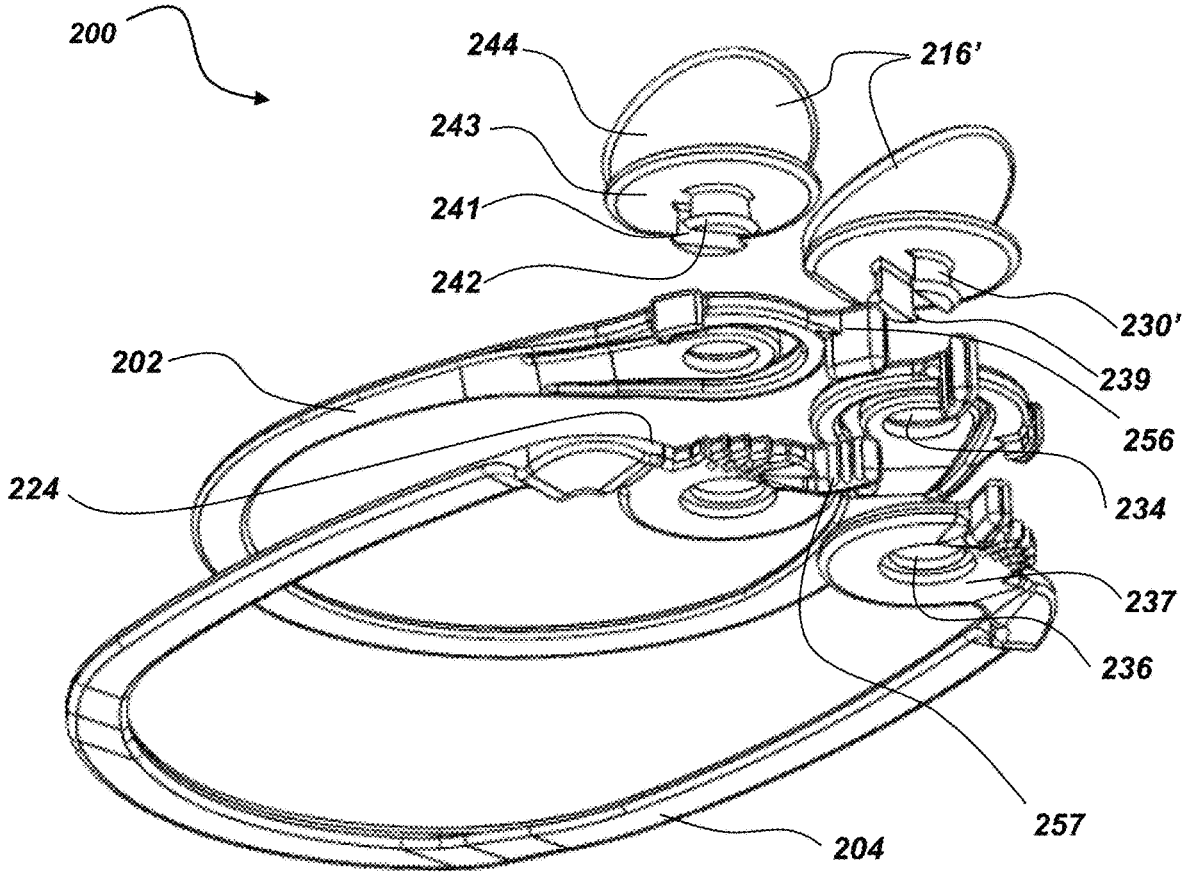
FIG. 9 is an exploded view of a support according to an embodiment of the present disclosure.

FIG. 9 shows an exploded view of an embodiment of the support 200 of FIGS. 2 through 7. In some embodiments, the pin 230' may be integral with the pad 216'. In some embodiments, the pin 230' may have a retaining lip 239. In some embodiments, the pin 230' may be split into two separate pieces with a gap 241 between two sides of the pin 230'. The pin 230' may be formed from a resilient material that may allow the two sides of the pin 230' to be compressed together to allow the retaining lip 239 to pass through the holes 234 and 236 in the bottom support 204 and the top support 202, respectively. Once inserted through the holes 234 and 236, the two sides of the pin 230' may return to a normal configuration. When in the normal configuration, the retaining lip 239 may contact a bottom surface 237 of the bottom support 204 retaining the pin 230' within the holes 234 and 236 securing the top support 202 to the bottom support 204 and forming the hinge 206 (FIG. 2). The retaining lip 239 and the pad 216' may substantially limit the movement of the top support 202 and the bottom support 204 such that the top support 202 and the bottom support 204 may only move relative to each other in a plane that is transverse (e.g., perpendicular) to an axis of the pin 230'. In some embodiments, a front surface 242 of the retaining lip 239 may include a chamfer. The chamfered front surface 242 may be configured to compress the two sides of the pin 230' as the pin 230' is inserted into the two holes 234 and 236.

Figure 10:
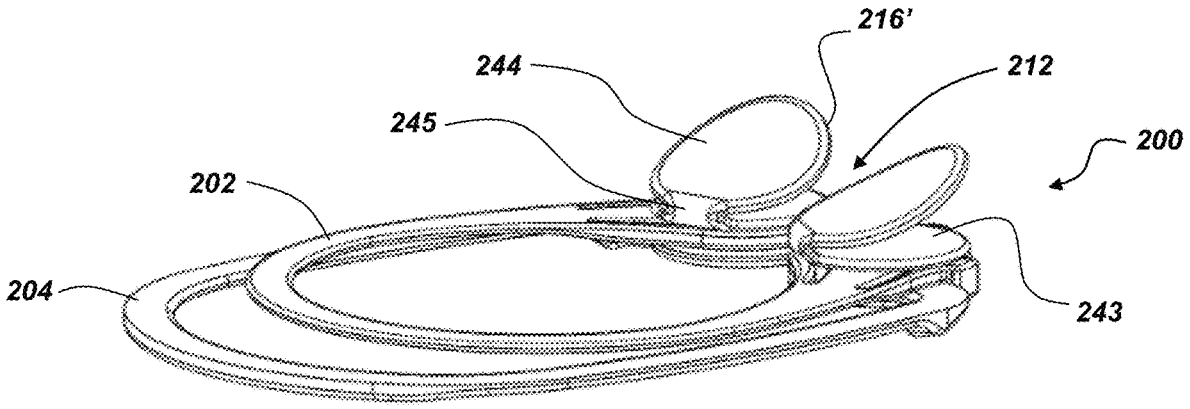
FIG. 10 is a perspective view of a support according to an embodiment of the present disclosure.

FIG. 10 illustrates the embodiment of FIG. 9 in a perspective view. In some embodiments, the pad 216' may be formed from a resilient material. In some embodiments, the pad 216' may have a retaining surface 243 and a pad surface 244. The retaining surface 243 may contact a top surface of the top support 202. The retaining surface 243 may be configured to act opposite the retaining lip 239 (FIG. 9) to limit the movement of the top support 202 and the bottom support 204 relative to one another. The pad surface 244 may connect to the retaining surface 243 at a point 245 near the opening 212 between the two hinges 206 (FIG. 2). The pad surface 244 may extend at an angle from the retaining surface 243. The angle may be between 90° and 10°, such as between about 45° and 25°, or between about 40° and 30°.

Figure 11:
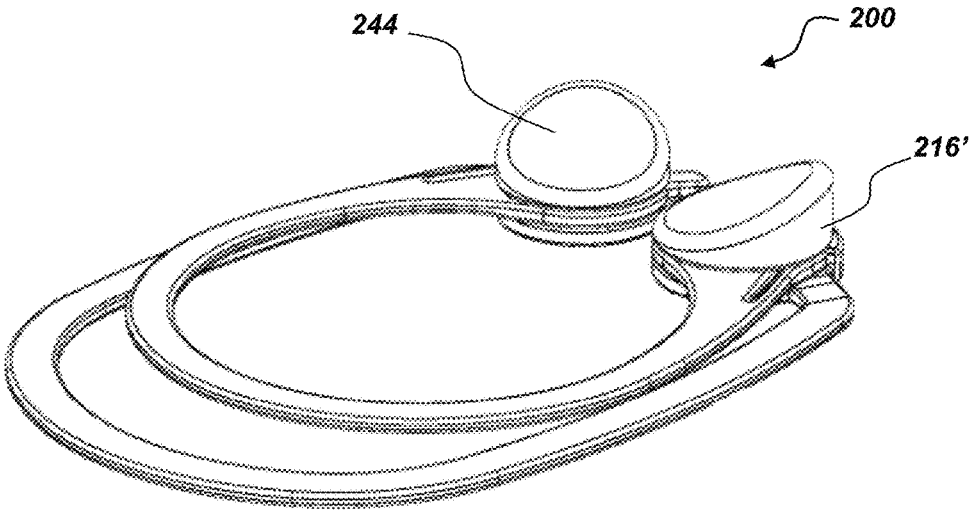
FIG. 11 is a perspective view of a support according to an embodiment of the present disclosure.

FIG. 11 illustrates an embodiment of the support 200 of FIGS. 9 and 10. In some embodiments, the pad 216' may be a solid part. The retaining surface 243 (FIG. 9) and the pad surface 244 may be opposing surfaces of the solid pad 216'. In some embodiments, the solid pad 216' may be formed in a wedge shape. The wedge shape may be formed with an angle between the retaining surface 243 and the pad surface 244. The angle may be between 90° and 0°, such as between about 45° and 25°, or between about 40° and 30°. In some embodiments, the pad surface 244 may be a concave surface. In some embodiments, the pad surface 244 may be a convex surface. The pad 216' may be selected for a shape that is complementary to the user. Different users may require different pad shapes to conform comfortably to the user's anatomy.

In some embodiments, the one or both of the hinges 206 may include a locking mechanism 250. The locking mechanism 250 may include a stop 252 (e.g., tooth, teeth, cogs, holes, etc.) and a retaining member 254 with a complementary feature to engage with the stop 252 (e.g., tooth, teeth, protrusion, latch, clasp, pin, cog, etc.). The locking mechanism 250 may lock the support 200 in an expanded position and/or the collapsed position. When the support 200 is in the desired position, the retaining member 254 may contact the stop 252 and substantially inhibit movement of the top support 202 relative to the bottom support 204 (e.g., a protrusion or tooth of the retaining member 254 may engage with one or more teeth of the stop 252). In some embodiments, the stop 252 and retaining member 254 may be configured to limit movement between the top support 202 and bottom support 204 in a single direction. For example, the stop 252 and the retaining member 254 may be configured to selectively enable (e.g., when a selected amount of force is applied) the top support 202 to rotate about the axis $L_{100}$ in a direction further expanding the support 200 while preventing the top support 202 from rotating in a direction collapsing the support 200. In other embodiments, the stop 252 and the retaining member 254 may be configured to selectively enable (e.g., when a selected amount of force is applied) rotation of the top support 202 relative to the bottom support 204 in both directions.

In some embodiments, the locking mechanism 250 may consist of high friction coatings such as, abrasive coatings (e.g., metal filings, metal oxides, ceramic materials, etc.), a rubberized coating, or other similar high friction coatings. The high friction coating may be on surfaces of the top support 202 and bottom support 204, which are in contact with each other. The high friction coating may substantially inhibit motion (e.g., until a select amount of force is applied) of the top support 202 relative to the lower support 204. In some embodiments, force on the front portion 210 of the top support 202 and front portion 214 of the bottom support 204 may increase the friction or reduce the friction inside the hinge 206, holding the support 200 in the expanded positioned when force is applied by a user during use of the support 200. For example, the top support 202 and the bottom support 204 may be configured to increase a pressure between the surfaces of the top support 202 and/or the bottom support 204, that have the high friction coating, when compressing force is applied to the front portion 210 of the top support 202 and the front portion 214 of the bottom support 204. In some embodiments, applying a force to the top support 202 and the bottom support 204 in another way may decrease the pressure between the surfaces of the top support 202 and/or the bottom support 204 that have the high friction coating to enable collapsing of the support 200. In some embodiments, decreasing the pressure between the high friction surfaces of the top support 202 and/or the bottom support 204 may decrease the locking force of the locking mechanism 250 substantially releasing the locking mechanism and allowing the top support 202 to move relative to the bottom support 204.

In some embodiments, the locking mechanism 250 may include a dampening mechanism. The dampening mechanism may substantially inhibit movement of the top support 202 relative to the bottom support 204 (e.g., when moving from the expanded position to the collapsed position and/or when moving from the collapsed position to the expanded position). In some embodiments, a dampening mechanism may utilize a dampener (e.g., spring, fluid, etc.) to substantially inhibit the movement. In some embodiments, the dampening mechanism may be adjustable to provide more or less force to inhibit the movement.

In some embodiments, the locking mechanism 250 may include a single stop 252 to lock the support 200 in the expanded position. In other embodiments, the locking mechanism 250 may include more than one stop 252. In some embodiments, the locking mechanism 250 may include a stop 252 to lock the support 200 in an expanded position and another stop 252 to lock the support 200 in the collapsed position. In some embodiments, the locking mechanism 250 may include a plurality of stops 252 for different expanded positions such that the support 200 may be adjustable to different expanded positions. The number of expanded positions may be defined by the number of stops 252.

In some embodiments, the locking mechanism 250 may include a ratcheting mechanism. In some embodiments, the ratcheting mechanism may include a plurality of teeth 252 on at least one of the top support 202 and the bottom support 204. In some embodiments, the bottom support 204 may include the plurality of teeth 252 for the ratcheting mechanism. The top support 202 may include a latch 254 (e.g., a complementary tooth). In other embodiments, the top support 202 may include the plurality of teeth 252 and the bottom support 204 may include the latch 254. In some embodiments, the latch 254 may be biased toward the teeth 252 by a biasing element (e.g., a spring, resilient material, etc.). The latch 254 may be configured to interact with the plurality of teeth 252. The plurality of teeth 252 may be positioned at an angle and configured to have a retaining face 258 and an advancing face 260. The latch 254 may contact the retaining face 258 of the plurality of teeth 252 to prevent the top support 202 from rotating about the axis $L_{100}$ relative to the bottom support 204 in a direction collapsing the support 200. The latch 254 may move along the advancing face 260 of the plurality of teeth 252 allowing the top support 202 to rotate relative to the bottom support 204 in a direction further expanding the support 200. Each tooth of the plurality of teeth 252 may define an expanded position of the support 200. In addition to the plurality of teeth 252 and the latch 254, the ratcheting mechanism may include one or more releases 256, 257. The releases 256, 257 (e.g., one release alone or multiple releases in unison) may be configured to disengage the latch 254 from the plurality of teeth 252, thereby, enabling the top support 202 to rotate relative to the bottom support 204 in a direction collapsing the support 200. In some embodiments, one or both of the releases 256, 257 may move the latch 254 in a direction (e.g., radially outward direction and/or a direction along the axis $L_{100}$) such that the latch 254 and the plurality of teeth 252 are no longer in contact. In other embodiments, one or both of the releases 256, 257 may move the latch 254 in a direction along (e.g., parallel to) the axis $L_{100}$ to disengage the latch 254 from the plurality of teeth 252. In some embodiments, one or both of the releases 256, 257 may move the latch 254 independent of the top support 202 and/or the bottom support 204. In other embodiments, the releases 256, 257 may move at least a portion of the support 202, 204 that includes the latch 254.

In some embodiments, the first release 256 and the second release 257 may work in unison to move the latch 254 relative to the plurality of teeth 252 to disengage the latch 254 and the plurality of teeth 252. For example, a user may apply a force (e.g., a pinch) to the first release 256 and the second release 257 in order to move the first release 256 toward the second release 257 disengaging the plurality of teeth 252 from the latch 254. Stated in another way, opposing forces may be applied to the first release 256 and the second release 257 to move both the plurality of teeth 252 and the latch 254 relative to each other. Moving the plurality of teeth 252 and the latch 254 relative to each other may cause the latch 254 and the plurality of teeth 252 to disengage.

In some embodiments, the plurality of teeth 252 in the ratchet may not be placed at an angle. The plurality of teeth 252 may have a retaining face 258 on both sides of each tooth. When the latch 254 contacts the retaining face 258 on either side of each tooth, the latch 254 may prevent the top support 202 from rotating relative to the bottom support 204 in both directions. In some embodiments, the release 256 may need to disengage the latch 254 to rotate the top support 202 in both directions about the axis $L_{100}$ relative to the bottom support 204.

In some embodiments, the locking mechanism 250 may include at least two interlocking cogs. A stop cog 252 may include a plurality of teeth and a latch cog 254 may include a complementary plurality of teeth. In some embodiments, the plurality of teeth may be configured to stop rotation of the top support 202 relative to the bottom support 204 in both directions. In other embodiments, the plurality of teeth may be configured to allow rotation of the top support 202 relative to the bottom support 204 in one direction while preventing rotation in the other direction. In some embodiments, a biasing element (e.g., spring, washer, resilient material) may bias the latch cog 254 to the stop cog 252. A release 256 may release the biasing element or act against the biasing element moving the latch cog 254 such that the teeth of the latch cog 254 are no longer in contact with the teeth of the stop cog 252.

Figure 12:
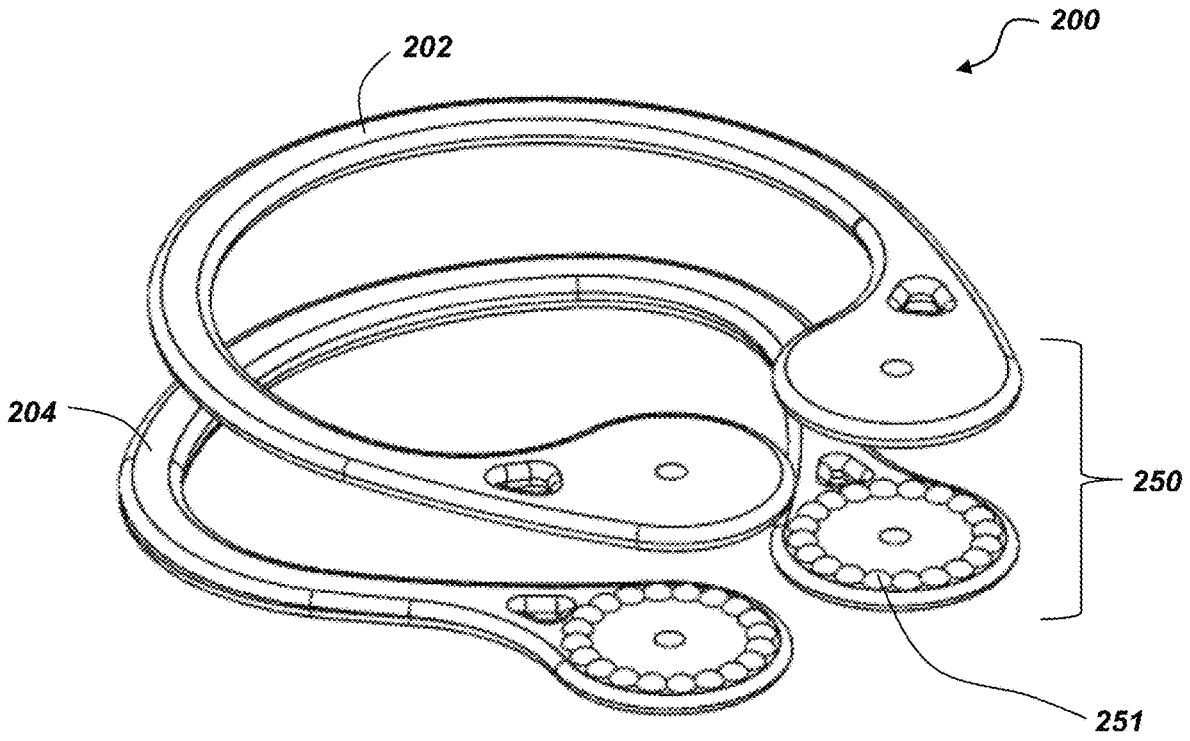
FIG. 12 is an exploded view of a support according to an embodiment of the present disclosure.

FIG. 12 is an exploded view of an embodiment of the support 200. In some embodiments, the support 200 may include a locking connection 250. In some embodiments, the locking connection 250 may include a plurality of protrusions (e.g., semispherical bumps 251) on at least one of the top support 202 or the bottom support 204. The opposing support 202 or 204 may include a complementary feature. For example, the bottom support 204 may include the plurality of bumps 251 and the top support 202 may include the plurality of complementary recesses. The locking connection 250 may be configured such that the number of bumps defines the number of possible positions for the support 200.

Figure 13:
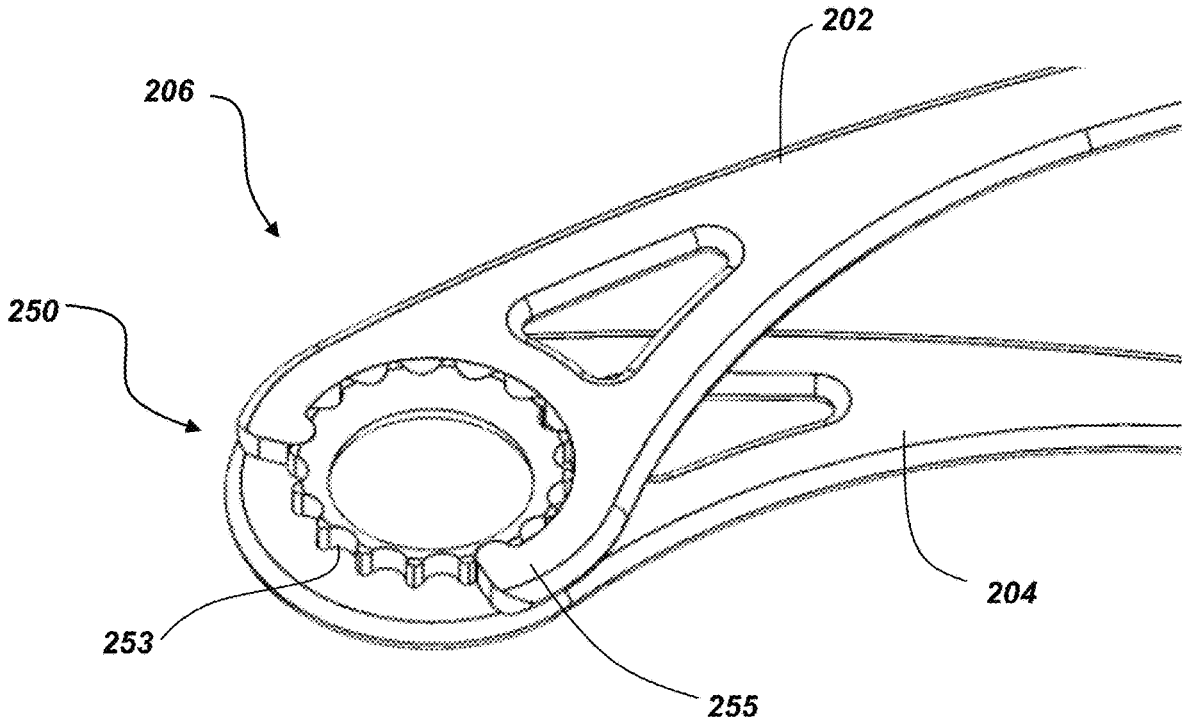
FIG. 13 is a view of a hinge according to an embodiment of the present disclosure.

FIG. 13 illustrates a close-up view of an embodiment of a joint or hinge 206 for an embodiment of the support 200. In some embodiments the locking connection 250 may comprise a plurality of detents 253 on at least one of the top support 202 or the bottom support 204. In some embodiments, the opposing support may include opposing fingers 255, which may be configured to act as a latch. The opposing fingers 255 may be inserted into the plurality of detents 253; locking the top support 202 relative to the bottom support 204. For example, the bottom support 204 may include a plurality of detents 253 and the top support 202 may include at least two opposing fingers 255 (e.g., semispherical protrusions). The opposing fingers 255 may be complementary to the plurality of detents 253. The plurality of detents 253 may be configured to allow the opposing fingers 255 to advance one direction while substantially preventing the opposing fingers 255 from advancing in the opposite direction.

Figure 14:
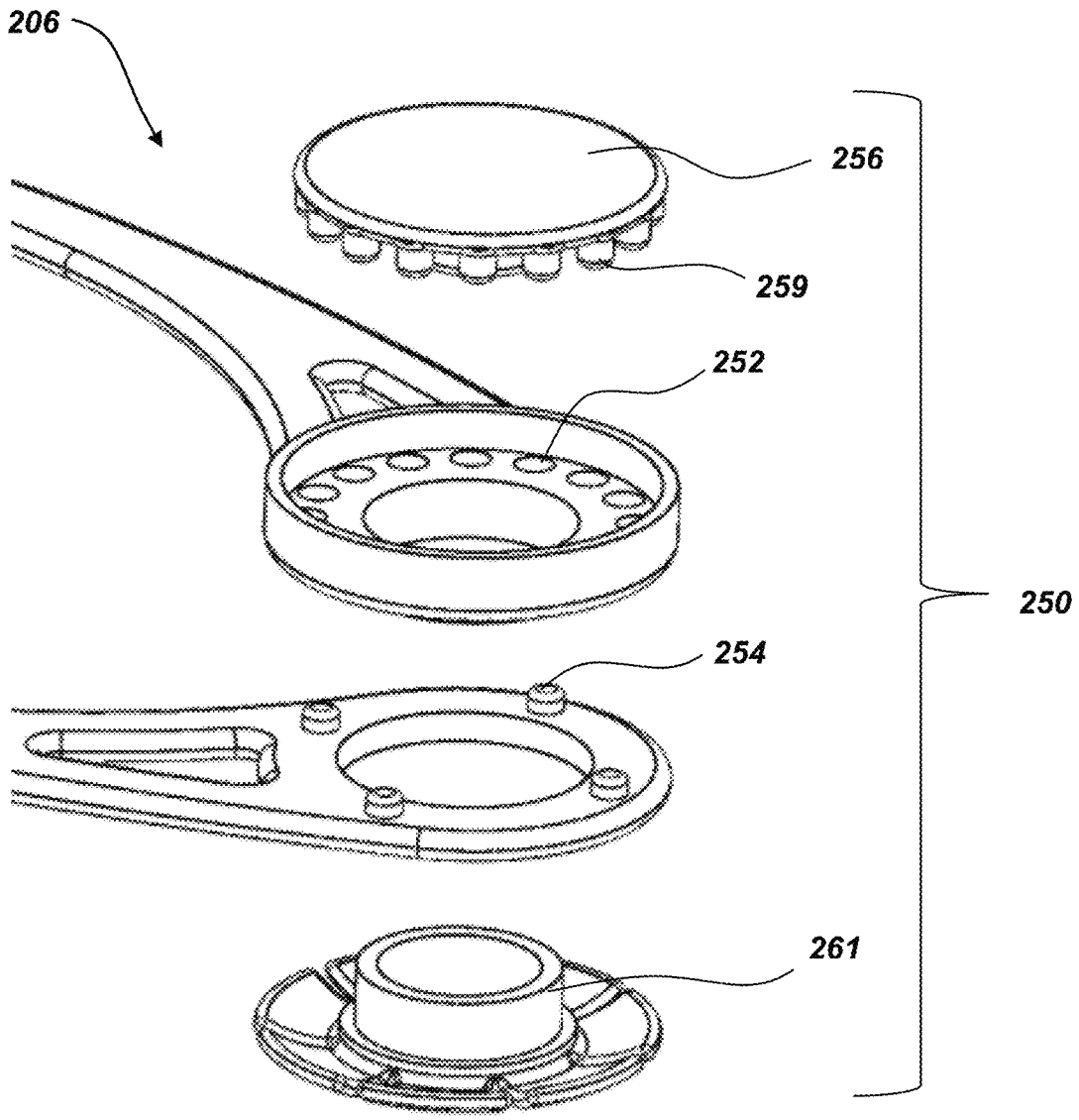
FIG. 14 is an exploded view of a hinge according to an embodiment of the present discloser.

FIG. 14 illustrates a close-up view of an embodiment of a joint or hinge 206 of the support 200. In some embodiments, the locking connection 250 may include a plurality of holes 252 acting as stops and at least one pin 254 acting as a latch. In some embodiments, the locking connection 250 may include more than one pin 254, such as two pins, three pins, or four pins. In some embodiments, the locking connection 250 may include the same number of pins 254 as holes 252. The pins 254 may have a complementary size and shape to the plurality of holes 252 such that the pins 254 may be inserted into the plurality of holes 252. In some embodiments, the latching connection 250 may include a release 256. In some embodiments, the release 256 may include release pins 259 opposing the pins 254, and a biasing element 261. The biasing element 261 may bias the release 256 to the locked position. The user may apply a force on the release 256 against the biasing force of the biasing element 261. When the user applies the force on the release 256, the release pins 259 may enter the plurality of holes 252, forcing the pins 254 out of the plurality of holes 252 releasing the latch. In some embodiments, the release 256 may include the same number of release pins 259 as the locking mechanism pins 254. The release 256 may mirror the pins 254, such that the release pins 259 are in substantially the same position as the pins 254. In some embodiments, the release 256 may include the same number of release pins 259 as the number of the plurality of holes 252. The release 256 may remain stationary relative to the holes 252 not rotating with the pins 254. In some embodiments, the release pins 259 may be a complementary size and shape to the holes 252. In some embodiments, the release pins 259 may be smaller than the pins 254 such that the release pins 259 may require less force than the pins 254 to insert into the plurality of holes 252, and to retract from the plurality of holes 252.

Now referring to FIGS. 1 through 14, in some embodiments, the locking mechanism 250 may also include range of motion stops configured to prevent the support 200, 200' from over extending or opening in the wrong direction. Range of motion stops may be an additional stop to the stops 252 of the locking mechanism 250. In some embodiments, the range of motion stops may be created by contact between the top support 202 and the bottom support 204. In other embodiments the range of motion stops may be a physical stop in the hinge 206 that will not allow additional movement beyond the range of motion stop. In some embodiments, the top support 202 and/or the bottom support 204 may have an extruded tab or detent. The extruded tab may contact the detent substantially preventing further movement of the top support and/or bottom support at the range of motion stop. In some embodiments, the tab and detent may have additional functions. For example, FIG. 9 illustrates a first release 256 that may interact with the second release 257 and the retaining member 254 to create two range of motion stops.

Figure 15:
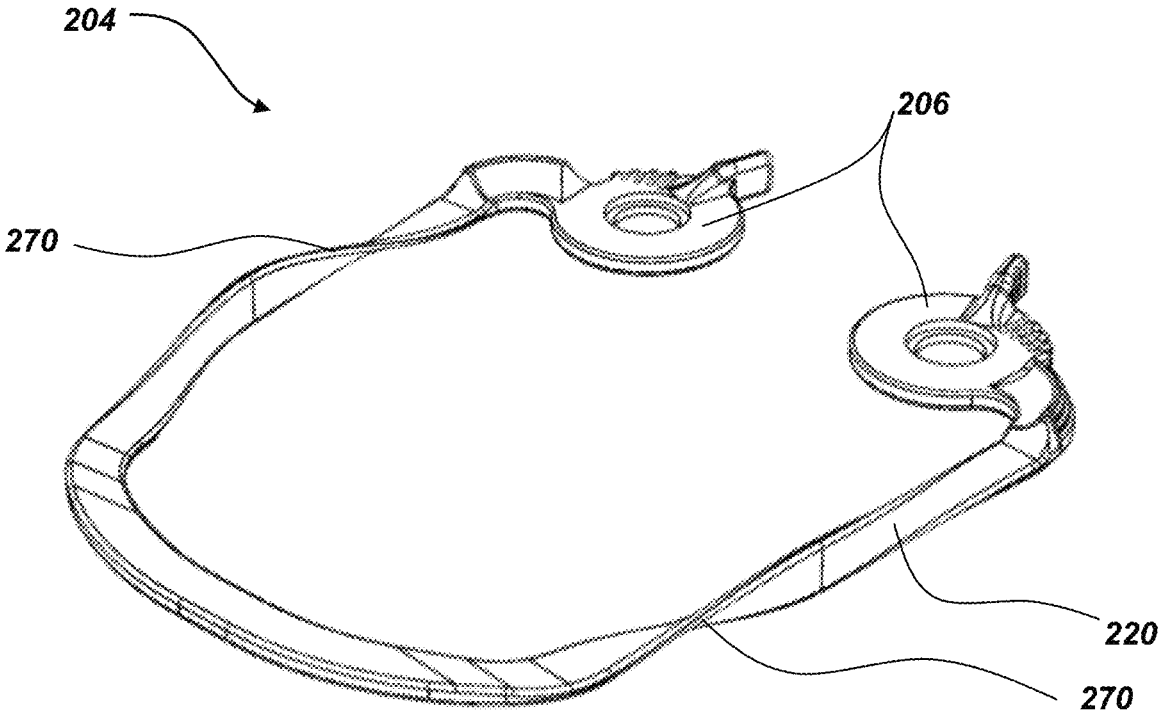
FIG. 15 is a perspective view of a lower support according to an embodiment of the present disclosure.

FIG. 15 illustrates an embodiment of the lower support 204 of the support 200, 200' demonstrated in FIGS. 2 through 10. In some embodiments, the lower support 204 may include an initial twist 270 in the sides 220 of the lower support 204. The initial twist 270 may be present when the support 200 is in the collapsed position. The initial twist 270 may introduce a twist opposite, the twisting force introduced by the hinge 206. When the support 200 is positioned in an expanded position the twisting force introduced by the hinge 206 may substantially straighten the sides 220 of the lower support 204. In some embodiments, the substantially straight sides 220 may conform to the user's chest, shoulders, and/or back for a more comfortable fit.

Figure 16:
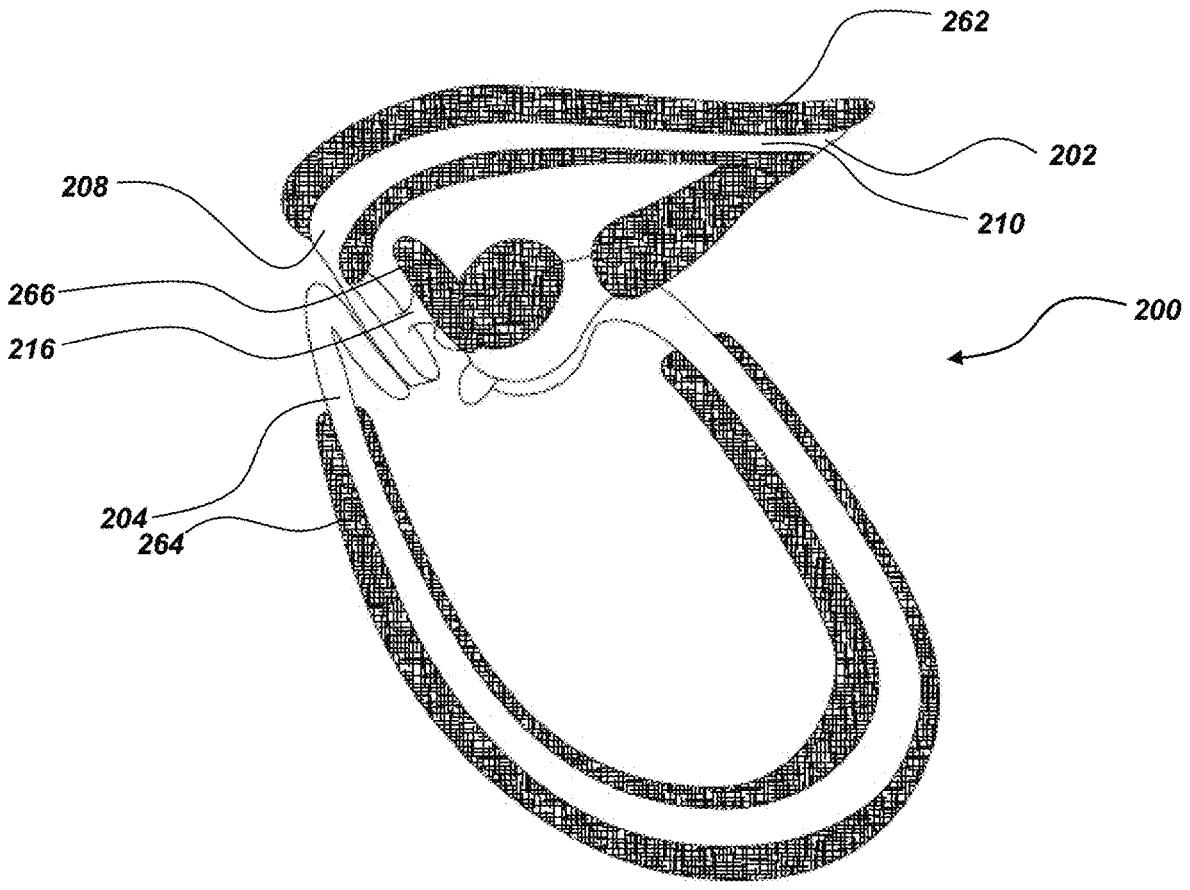
FIG. 16 is a perspective view of a support in an expanded position according to an embodiment of the present disclosure.

FIG. 16 is a perspective view of a support in an expanded position (e.g., the support 200 of FIGS. 2 through 7). As shown in FIG. 16, the support 200 may have covers on at least a portion of one or more of the elements. For example, in some embodiments, a top cover 262 may be attached to the top support 202. In some embodiments, a bottom cover 264 may be attached to the bottom support 204. In some embodiments, a pad cover 266 may be attached to the pads 216. In some embodiments, the support 200 may include the top cover 262, the bottom cover 264, and the pad covers 266. In other embodiments, the support 200 may only include some of the covers. For example, the support 200 may only include the top cover 262 and the bottom cover 264, or the top cover 262 and the pad covers 266, or the bottom cover 264 and the pad covers 266. In some embodiments, the covers 262, 264, 266 may only cover portions of the elements. For example, the top cover 262 may only cover the side portions 208 of the top support 202, or the top cover 262 may only cover the front portion 210 of the top support. In some embodiments, at least two of the covers may be integrated into a single part. For example, the top cover 262 and the pad covers 266 may be integrated in to a single part. In some embodiments, the top cover 262 and the bottom cover 264 may be integrated into a single part. In some embodiments, the top cover 262, bottom cover 264, and the pad covers 266 may all be integrated into a single part.

The covers 262, 264, 266 may be made from cushioning materials (e.g., foam, gel, vinyl, rubber, natural or synthetic fibers). The cushioning materials may be attached to the support 200 using glue (e.g. hot glue, water-based glue etc.), hook-and-loop adhesives, staples, fabric covers, hook-and-loop fasteners (e.g., VELCRO®), snaps, buttons, etc. In some embodiments, the covers 262, 264, 266 may cover only one side of each element of the support. For example, the top cover 262 may only cover the side of the top support 202 that contacts the user. In other embodiments, the covers 262, 264, 266 may envelop each element. For example, the bottom cover 264 may comprise a sleeve of fabric and the bottom support 204 may be disposed within the bottom cover 264.

Figure 17:
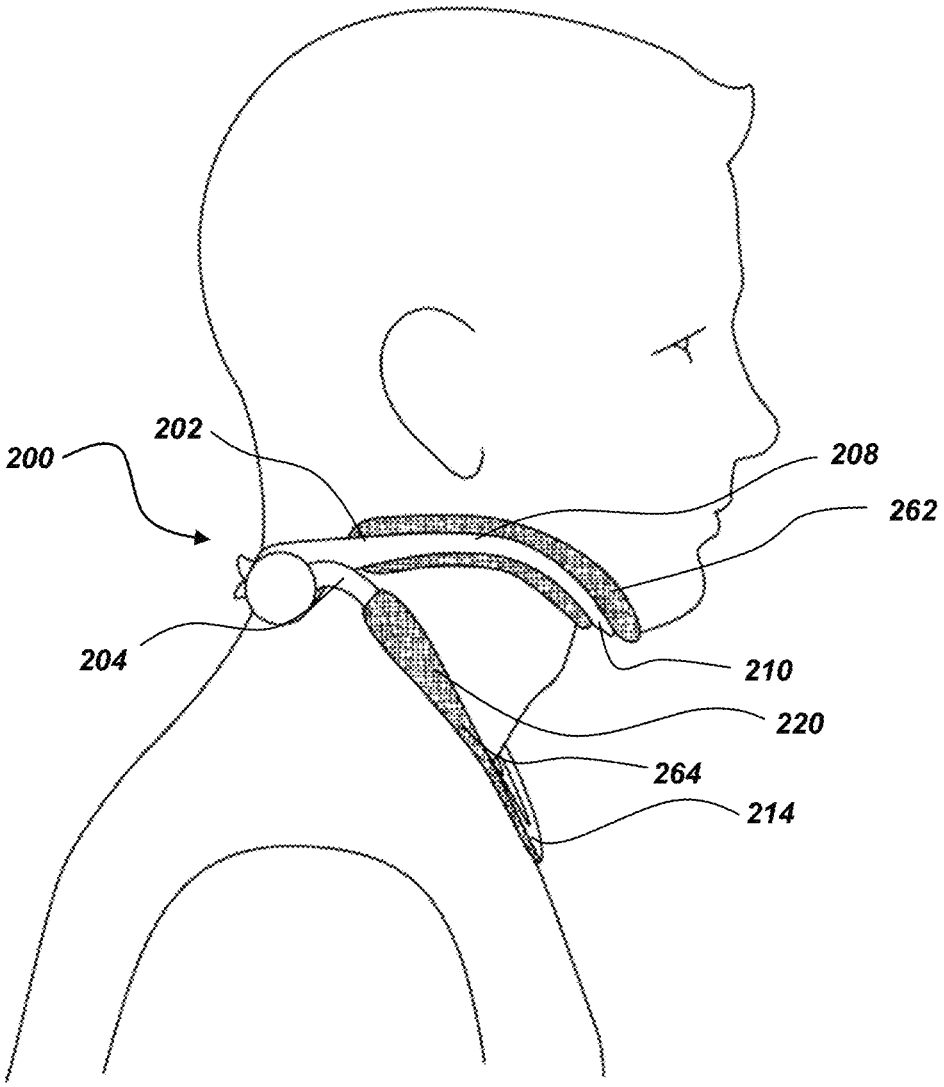
FIG. 17 is a side view of a user wearing a support in the neck region according to an embodiment of the present disclosure.

FIG. 17 illustrates an embodiment of the present disclosure being used as a head and/or neck support. As shown in FIG. 17, when placed on a user, the planar surfaces of the support 200 may substantially follow the contours of the user's body. For example, the support 200 may be placed around a user's neck. When placed around the user's neck, the side portions 208 of the top support 202 may follow the vertical contours (e.g., along the sagittal and/or coronal plane) of the side of the user's face (e.g., cheek, neck or side of the jaw). The planar surface may gradually transition following the contour of the jaw line of the user until the front portion 210 passes under the chin of the user as a substantially horizontal surface (e.g., along the transverse plane). The planar surface of the bottom support 204 may also follow the contours of the user's body. For example, the sides 220 of the bottom support 204 may extend in a plane substantially parallel to the user's neck and the planar surface of the bottom support 204 may gradually transition to the front portion 214 of the bottom support 204 which may lie in a plane substantially parallel to the user's chest. In some embodiments, the bottom support sides 220 of the bottom support may also lie in a plane substantially parallel to the user's chest along with the front portion 214 to follow the contours of the user's chest. The top cover 262 and bottom cover 264 may conform to any irregularities in the user's anatomy to provide a tight comfortable fit.

Embodiment of the disclosure may comprise supports (e.g., foldable supports) having numerous benefits. For example, large and cumbersome supports are difficult to travel with and may take up valuable space in luggage when traveling and in storage areas when not in use. A support that folds flat may make traveling with a support device less frustrating and storage of the support less difficult. Additionally, a support that is adjustable has several advantages over supports, such as pillows, with minimal adjustment because people are all different shapes and sizes. As a result, a support that works for one user may be too large or too small for another user. A support that can be adjusted may allow multiple different people to comfortably use the same support. The adjustable shape of the support may also increase the comfort for the user using the support, and reduce fatigue on the surrounding joints and muscles when resting on the support.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated by the inventors.

What is claimed is:

1. A support comprising:

a first portion configured to support a portion of a user's head;

a second portion configured to engage with at least one of the user's chest, shoulders, or back; and at least one coupling member connecting the first portion and the second portion, the at least one coupling member configured to selectively enable movement of the first portion relative to the second portion and to apply a force between the first portion and the second portion when the support is in an expanded position to counteract a weight of the user's head engaging with the first portion, wherein:

the support is configured to compress into a collapsed position;

the first portion and the second portion are each configured to lie in parallel planes when the support is in the collapsed position; and the first portion is configured to define an at least partially twisted surface of the first portion when the support is in the expanded position.

2. The support of claim 1, wherein the at least one coupling member is configured to introduce a twist into the first portion to define the at least partially twisted surface of the first portion when the support is in the expanded position.

3. The support of claim 1, further comprising a releasable locking connection configured to apply the force in order to secure the first portion relative to the second portion.

4. The support of claim 3, wherein the releasable locking connection further comprises a ratcheting connection.

5. The support of claim 1, wherein the at least one coupling member is configured to enable movement of the first portion away from the second portion and configured to substantially prevent movement of the first portion back toward the second portion.

6. The support of claim 1, further comprising a padded cover surrounding at least a portion of the first portion.

7. A method of adjusting a support comprising:

providing the support comprising a head supporting frame and a lower support frame directly connected by a hinge assembly, each of the head supporting frame and the lower support frame having an arcuate shape extending from a first hinge of the hinge assembly to a second hinge of the hinge assembly;

articulating the head supporting frame relative to the lower support frame about the hinge assembly;

supporting a user's head with the head supporting frame having a shape that is at least partially complementary to a lower portion the user's head;

cushioning the user's head with a cover comprising a cushioning material on the head supporting frame; and securing the head supporting frame in a desired position relative to the lower support frame with the hinge assembly.

8. The method of claim 7, further comprising articulating the head supporting frame until the head supporting frame lies in a first plane that is substantially parallel with and adjacent to a second plane containing the lower support frame to position the support in a retracted position.

9. The method of claim 7, further comprising defining an at least partially twisted surface in the head supporting frame when the support is in an expanded position.

10. The method of claim 9, further comprising defining an at least partially twisted surface in the lower support frame when the support is in the expanded position.

11. The method of claim 7, further comprising cushioning at least one of the user's chest, shoulders, or back with a cover comprising a cushioning material on the lower support frame.

12. A foldable support comprising:

a top support with an adjustable shape;

a bottom support;

at least one hinged connection connecting the top support to the bottom support and configured to change the adjustable shape of the top support by defining an at least partially twisted surface in the top support when the foldable support is in an expanded position; and a locking mechanism configured to lock the top support relative to the bottom support.

13. The foldable support of claim 12, wherein the at least one hinged connection is configured to enable the top support to move relative to the bottom support until the top support is adjacent to the bottom support.

14. The foldable support of claim 13, wherein the top support substantially lies in a plane that is substantially parallel to a plane that the bottom support substantially lies in when the top support is adjacent to the bottom support in a collapsed position.

15. The foldable support of claim 14, wherein the foldable support exhibits a substantially flat orientation when the top support is adjacent to the bottom support.

16. The foldable support of claim 12, wherein the locking mechanism comprises a releasable locking mechanism, wherein the releasable locking mechanism comprises at least one release configured to disengage the locking mechanism.

17. The foldable support of claim 16, wherein the at least one release is attached to a latching member of the releasable locking mechanism.

18. The foldable support of claim 17, wherein the releasable locking mechanism comprises at least two releases, wherein a first release is attached to the latching member of the releasable locking mechanism and a second release is attached to a stop of the releasable locking mechanism.

19. The foldable support of claim 12, wherein the locking mechanism comprises a plurality of stops, wherein the plurality of stops is configured to place the foldable support in a plurality of positions.

20. The foldable support of claim 12, wherein the top support and the bottom support comprise an elastomeric polymer.

* * * * *